US008627960B2

(12) United States Patent
Valerio et al.

(10) Patent No.: US 8,627,960 B2
(45) Date of Patent: Jan. 14, 2014

(54) APPARATUS AND METHOD FOR SEPARATING MATERIALS USING AIR

(75) Inventors: Thomas A. Valerio, New Port Richey, FL (US); Daniel P. Creighton, San Jose, CA (US)

(73) Assignee: MTD America Ltd (LLC), Atlanta, GA (US)

( * ) Notice: Subject to any disclaimer, the term of this patent is extended or adjusted under 35 U.S.C. 154(b) by 0 days.

(21) Appl. No.: 12/769,525

(22) Filed: Apr. 28, 2010

(65) Prior Publication Data

US 2011/0067569 A1 Mar. 24, 2011

Related U.S. Application Data

(60) Provisional application No. 61/214,794, filed on Apr. 28, 2009.

(51) Int. Cl.
*B07B 7/00* (2006.01)

(52) U.S. Cl.
USPC ..... 209/139.1; 209/140; 209/143

(58) Field of Classification Search
USPC ..... 209/138, 139.1, 140, 141, 142, 143, 209/715, 720, 154
See application file for complete search history.

(56) References Cited

U.S. PATENT DOCUMENTS

| | | | | |
|---|---|---|---|---|
| 2,236,548 | A * | 4/1941 | Prouty | 241/41 |
| 2,587,686 | A | 3/1952 | Robert | |
| 3,409,025 | A * | 11/1968 | Wochnowski | 131/303 |
| 3,448,778 | A | 6/1969 | Ramsay | |
| 3,490,702 | A | 1/1970 | Dore | |
| 3,568,839 | A | 3/1971 | Dunlea | |
| 3,588,686 | A | 6/1971 | Lingmann et al. | |
| 3,670,969 | A | 6/1972 | Terada | |
| 3,701,419 | A | 10/1972 | Hutter et al. | |
| 3,702,133 | A | 11/1972 | Vibert et al. | |

(Continued)

FOREIGN PATENT DOCUMENTS

| | | |
|---|---|---|
| DE | 4306781 | 9/1994 |
| EP | 0332564 | 9/1989 |

(Continued)

OTHER PUBLICATIONS

Hottenstein. Beyond Density. Recycling Today [online]. Nov. 18, 2008, http://www.recyclingtoday.com/Article.aspx?article_id=21468.

(Continued)

*Primary Examiner* — Joseph C Rodriguez
(74) *Attorney, Agent, or Firm* — King & Spalding

(57) ABSTRACT

Separating a mixture comprising at least two solid materials comprises transporting the mixture into a plenum, introducing air into the plenum, removing a heavier fraction of the solid materials from the plenum, removing air having a lighter fraction of the solid materials entrained therein from the plenum, removing the lighter fraction of the solid materials from the air that is removed from the plenum, filtering the remaining air, and re-circulating the air back to the plenum. Valves at the locations where material is introduced to and removed from the system can prevent air flow therethrough while allowing the materials to pass. The air can be introduced into the plenum at an angle with respect to the pathway in which the heavier fraction of the materials falls through the plenum, thereby avoiding damage to a screen that diffuses the air being introduced into the plenum.

26 Claims, 10 Drawing Sheets

(56) References Cited

U.S. PATENT DOCUMENTS

| | | | | | |
|---|---|---|---|---|---|
| 3,702,682 | A | | 11/1972 | Williams | |
| 3,905,556 | A | | 9/1975 | Drage | |
| 3,975,263 | A | | 8/1976 | Elo | |
| 4,061,274 | A | * | 12/1977 | Williams | 241/19 |
| 4,299,694 | A | * | 11/1981 | Goodell | 209/139.1 |
| 4,317,521 | A | | 3/1982 | Clark | |
| 4,362,276 | A | | 12/1982 | Morey | |
| 4,387,019 | A | | 6/1983 | Dale et al. | |
| 4,405,451 | A | | 9/1983 | Roman | |
| 4,461,428 | A | * | 7/1984 | Williams | 241/34 |
| 4,541,530 | A | | 9/1985 | Kenny et al. | |
| 4,557,386 | A | | 12/1985 | Buckley et al. | |
| 4,563,644 | A | | 1/1986 | Lenander et al. | |
| 4,576,286 | A | | 3/1986 | Buckley et al. | |
| 4,597,487 | A | | 7/1986 | Crosby | |
| 4,718,559 | A | | 1/1988 | Kenny et al. | |
| 4,724,384 | A | | 2/1988 | Castovilly et al. | |
| 4,848,590 | A | | 7/1989 | Kelly | |
| 4,851,110 | A | | 7/1989 | Rolle et al. | |
| 4,933,075 | A | | 6/1990 | Nordin | |
| 4,940,187 | A | | 7/1990 | Lee | |
| 4,986,410 | A | | 1/1991 | Shields | |
| 5,000,390 | A | | 3/1991 | Marrs | |
| 5,022,985 | A | | 6/1991 | Nugent | |
| 5,025,929 | A | | 6/1991 | Carrera | |
| 5,139,150 | A | | 8/1992 | Fuller | |
| 5,148,993 | A | | 9/1992 | Kashiwagi | |
| 5,169,073 | A | | 12/1992 | Marabini | |
| 5,209,355 | A | | 5/1993 | Mindermann | |
| 5,260,576 | A | | 11/1993 | Sommer | |
| 5,273,166 | A | | 12/1993 | Sawamura | |
| 5,314,071 | A | | 5/1994 | Christian | |
| 5,314,072 | A | | 5/1994 | Frankel et al. | |
| 5,335,791 | A | | 8/1994 | Eason | |
| 5,341,935 | A | | 8/1994 | Djerf et al. | |
| 5,344,025 | A | | 9/1994 | Tyler et al. | |
| 5,344,026 | A | | 9/1994 | Booth et al. | |
| 5,361,909 | A | | 11/1994 | Gemmer | |
| 5,413,222 | A | | 5/1995 | Holder | |
| 5,433,157 | A | | 7/1995 | Dittmann et al. | |
| 5,443,157 | A | | 8/1995 | Baker et al. | |
| 5,465,847 | A | | 11/1995 | Gilmore | |
| 5,468,291 | A | | 11/1995 | Waterson et al. | |
| 5,502,559 | A | | 3/1996 | Powell et al. | |
| 5,512,758 | A | | 4/1996 | Kobayashi et al. | |
| 5,535,891 | A | | 7/1996 | Kuniyone et al. | |
| 5,548,214 | A | | 8/1996 | Yasohama | |
| 5,555,324 | A | | 9/1996 | Waxman et al. | |
| 5,555,984 | A | | 9/1996 | Sommer | |
| 5,562,743 | A | | 10/1996 | Daugherty | |
| 5,611,493 | A | | 3/1997 | Hayashi et al. | |
| 5,624,525 | A | | 4/1997 | Ehara | |
| 5,628,409 | A | | 5/1997 | Thomas | |
| 5,632,381 | A | | 5/1997 | Thust et al. | |
| 5,667,151 | A | | 9/1997 | Miura et al. | |
| 5,678,775 | A | | 10/1997 | Chapman | |
| 5,727,689 | A | * | 3/1998 | Anderson et al. | 209/139.1 |
| 5,739,524 | A | | 4/1998 | Fally | |
| 5,791,489 | A | | 8/1998 | Leifeld | |
| 5,801,530 | A | | 9/1998 | Crosby | |
| 5,829,600 | A | | 11/1998 | Jordan et al. | |
| 5,829,694 | A | | 11/1998 | Chapman | |
| 6,100,488 | A | | 8/2000 | Satake et al. | |
| 6,112,903 | A | | 9/2000 | Kimmel | |
| 6,124,560 | A | | 9/2000 | Roos | |
| 6,144,004 | A | | 11/2000 | Doak | |
| 6,191,580 | B1 | | 2/2001 | Guichard | |
| 6,199,779 | B1 | | 3/2001 | Mosher | |
| 6,283,300 | B1 | * | 9/2001 | Bielagus et al. | 209/29 |
| 6,313,422 | B1 | | 11/2001 | Anibas | |
| 6,319,389 | B1 | | 11/2001 | Fountain et al. | |
| 6,420,866 | B1 | | 7/2002 | Goldberg et al. | |
| 6,452,396 | B2 | | 9/2002 | Ott | |
| 6,497,324 | B1 | | 12/2002 | Doak | |
| 6,568,612 | B1 | | 5/2003 | Aoki | |
| 6,669,839 | B2 | | 12/2003 | Tipton et al. | |
| 6,696,655 | B2 | | 2/2004 | Harbeck et al. | |
| 6,838,886 | B2 | | 1/2005 | Hilliard | |
| 6,914,678 | B1 | | 7/2005 | Ulrichsen et al. | |
| 6,984,767 | B2 | | 1/2006 | Hunt | |
| 7,173,411 | B1 | | 2/2007 | Pond | |
| 7,296,340 | B2 | | 11/2007 | Sakaida et al. | |
| 7,351,376 | B1 | | 4/2008 | Quake et al. | |
| 7,351,929 | B2 | | 4/2008 | Afsari et al. | |
| 7,354,733 | B2 | | 4/2008 | Bukshpan et al. | |
| 7,449,655 | B2 | | 11/2008 | Cowling | |
| 7,674,994 | B1 | | 3/2010 | Valerio | |
| 7,786,401 | B2 | | 8/2010 | Valerio | |
| 8,016,117 | B2 | * | 9/2011 | Althouse | 209/154 |
| 2001/0045378 | A1 | | 11/2001 | Charles et al. | |
| 2002/0074274 | A1 | | 6/2002 | Pegga | |
| 2003/0052684 | A1 | | 3/2003 | Nelson et al. | |
| 2004/0144693 | A1 | | 7/2004 | Tse | |
| 2005/0242006 | A1 | | 11/2005 | Bohlig | |
| 2006/0037889 | A1 | | 2/2006 | Fitch | |
| 2006/0219276 | A1 | | 10/2006 | Bohnert | |
| 2007/0045158 | A1 | | 3/2007 | Johnson | |
| 2007/0084757 | A1 | | 4/2007 | Jeon et al. | |
| 2007/0098625 | A1 | | 5/2007 | Adams | |
| 2007/0187299 | A1 | | 8/2007 | Valerio | |
| 2007/0187305 | A1 | | 8/2007 | Valerio | |
| 2007/0262000 | A1 | | 11/2007 | Valerio | |
| 2008/0257794 | A1 | | 10/2008 | Valerio | |
| 2009/0250384 | A1 | | 10/2009 | Valerio | |
| 2010/0005926 | A1 | | 1/2010 | Valerio | |

FOREIGN PATENT DOCUMENTS

| | | |
|---|---|---|
| EP | 0541403 | 5/1993 |
| SU | 1039567 | 9/1983 |
| SU | 1606208 | 11/1990 |
| WO | WO 2006/131377 | 12/2006 |
| WO | 2009067570 | 5/2009 |
| WO | WO 2004/657570 | 5/2009 |
| WO | WO 2009/067570 A1 | 5/2009 |

OTHER PUBLICATIONS

Goosey et al. A Scoping Study: End-of-Life Printed Circuit Boards [online]. 2002, http://cfsd.org.uk/seeba/TD/reports/PCB_Study.pdf.

Felasco, R. Timothy, "NM's Investment—recovery journey," Central New York Business Journal, V 10 N 19 P 10B., 1996, 5 pgs.

* cited by examiner

APPARATUS AND METHOD FOR SEPARATING MATERIALS USING AIR

RELATED APPLICATION

This application claims priority to U.S. Provisional Patent Application No. 61/214,794 filed Apr. 28, 2009 and entitled "Apparatus For Separating Recycled Materials Using Air." The complete disclosure of the above-identified priority application is hereby fully incorporated herein by reference.

TECHNICAL FIELD

This invention relates to an apparatus for sorting materials. More particularly, the invention relates to an apparatus that employs closed-system air separation to sort and recover materials from recyclable materials.

BACKGROUND

Recycling of waste materials is highly desirable from many viewpoints, not the least of which are financial and ecological. Properly sorted recyclable materials often can be sold for significant revenue. Many of the more valuable recyclable materials do not biodegrade within a short period. Therefore, recycling such materials significantly reduces the strain on local landfills and ultimately the environment.

Typically, waste streams are composed of a variety of types of waste materials. One such waste stream is generated from the recovery and recycling of automobiles or other large machinery and appliances. For example, at the end of its useful life, an automobile will be shredded. This shredded material can be processed to recover ferrous metals. The remaining materials, referred to as automobile shredder residue (ASR) typically would be disposed in a landfill. Recently, efforts have been made to recover additional materials from ASR, such as plastics and non-ferrous metals. Similar efforts have been made to recover materials from whitegood shredder residue (WSR), which are the waste materials left over after recovering ferrous metals from shredded machinery or large appliances. Other waste streams may include electronic components, building components, retrieved landfill material, or other industrial waste streams. These materials generally are of value only when they have been separated into like-type materials. However, in many instances, cost-effective methods are not available to effectively sort waste streams that contain diverse materials. This deficiency has been particularly true for non-ferrous materials, and particularly for non-metallic materials, such as high density plastics, and non-ferrous metals, including copper wiring. For example, one approach to recycling plastics has been to station a number of laborers along a sorting line, each of whom manually sorts through shredded waste and manually selects the desired recyclables from the sorting line. This approach is not sustainable in most economies because the labor cost component is too high. Also, while ferrous recycling has been automated for some time, mainly through the use of magnets, this technique is ineffective for sorting non-ferrous materials. Again, labor-intensive manual processing has been employed to recover wiring and other non-ferrous metal materials. Because of the cost of labor, many of these manual processes are conducted in other countries and transporting the materials to and from these countries adds to the cost.

Copper wiring and other valuable non-ferrous metals can be recovered and recycled. However, waste materials, including ASR and WSR, must be separated from a concentrated mass of recoverable materials. Typically, the waste materials will include wood, rubber, plastics, glass, fabric, and copper wiring and other non-ferrous metals. The fabric includes carpet materials from the shredded automobiles. Often, the fabric includes embedded ferrous materials accumulated during the shredding process. Methods are known for separating the non-ferrous metals from these other materials. These methods may include a "pre-concentration" process that roughly separates the materials for further processing. However, these methods typically involve density separation processes. These processes typically involve expensive chemicals or other separation media and are almost always a "wet" process. These wet processes are inefficient for a number of reasons. After separation, often the separation medium must be collected to be reused. Also, these wet processes typically are batch processes, and they cannot process a continuous flow of material.

Another known system uses an air aspirator, or separator, to separate a light fraction of materials, which typically contains the waste materials that are not worth recovering (that is, the wood, rubber, and fabric), from a heavy fraction of materials, which typically includes the metals to be recovered. These types of separators are known in other industries as well, such as the agricultural industry, which uses air separators to separate materials of differing densities. However, these known systems usually employ open systems, where air is moved through the system and then released to the atmosphere. One problem with these systems is that they need air permits to operate, which adds cost to the system.

Conventional systems also force air directly up from a bottom of the plenum, and the material being separated falls on top of a screen at the bottom of the plenum. Accordingly, such systems cannot process heavy materials because the heavy materials will damage the screen when those materials fall on top of the screen.

Accordingly, a need exists in the art for a system and method that processes materials to be separated while recycling air in a closed system. Additionally, a need exists for a system and method that can separate heavier materials without damaging the system.

SUMMARY

The invention relates to a closed air system for separating materials. A fan directs air into a plenum in which the materials are separated. A heavier fraction of the materials falls through the air in the plenum to the bottom of the plenum. A stream of air carrying a lighter fraction of the materials exits the plenum and is directed to an expansion chamber. In the expansion chamber, the lighter fraction of the materials falls to the bottom as the velocity of the air slows. The air then flows from the expansion chamber to a centrifugal filter, which removes remaining material from the air. The air then returns to the fan where it is re-circulated through the system.

The separated materials can be removed from the system at the bottom of the plenum, the bottom of the expansion chamber, and the bottom of the centrifugal filter. Rotary Valves ("Air Locks") at these locations prevent air from flowing therethrough while allowing the materials to pass.

DETAILED DESCRIPTION OF EXEMPLARY EMBODIMENTS

Figure 1:
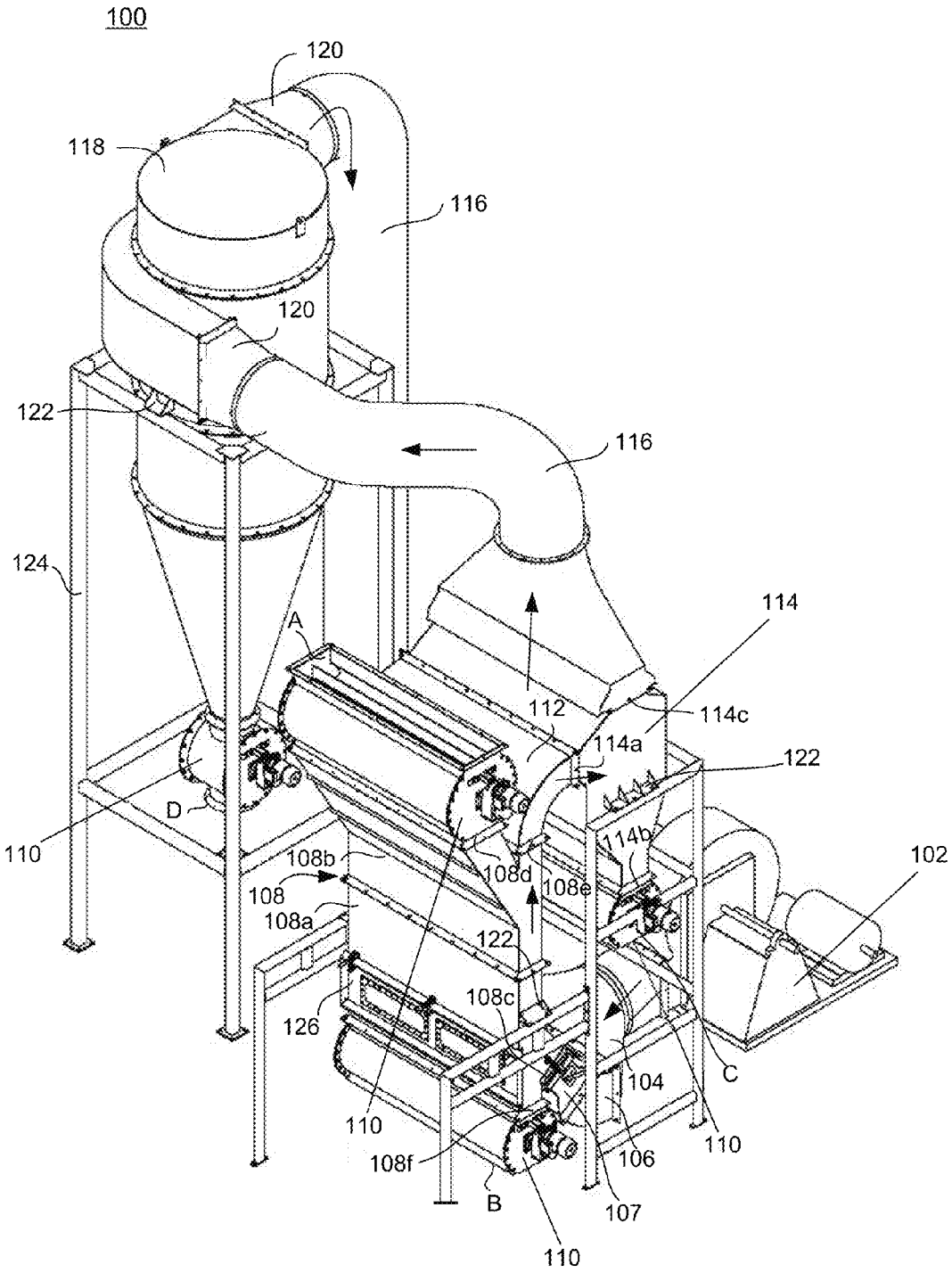
FIGS. 1, 2, and 3 are perspective, side, and top views, respectively, of an air separation classifier according to an exemplary embodiment.

Referring to the drawings, in which like numerals represent like elements, aspects of the exemplary embodiments will be described.

Figure 2:
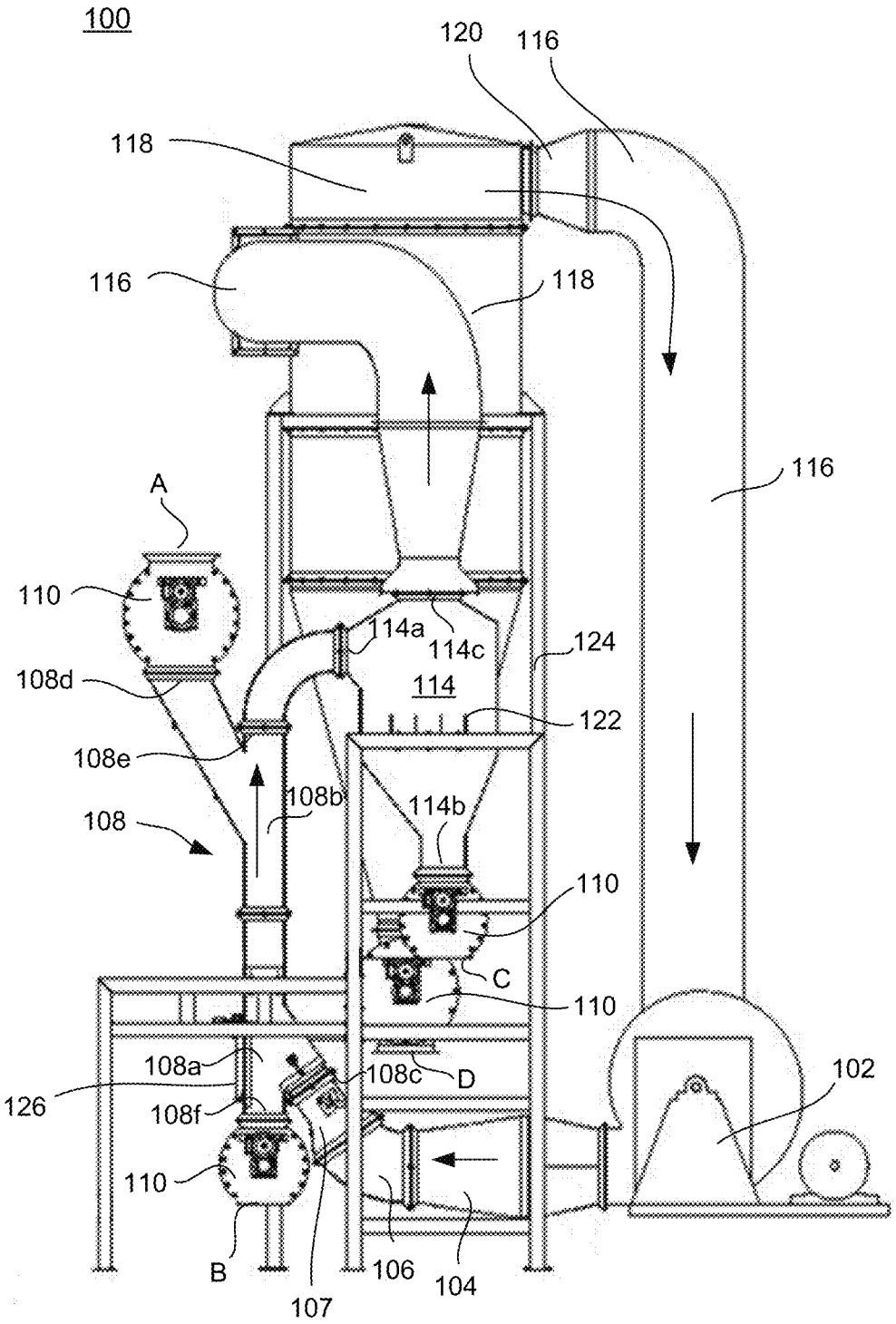
Figure 3:
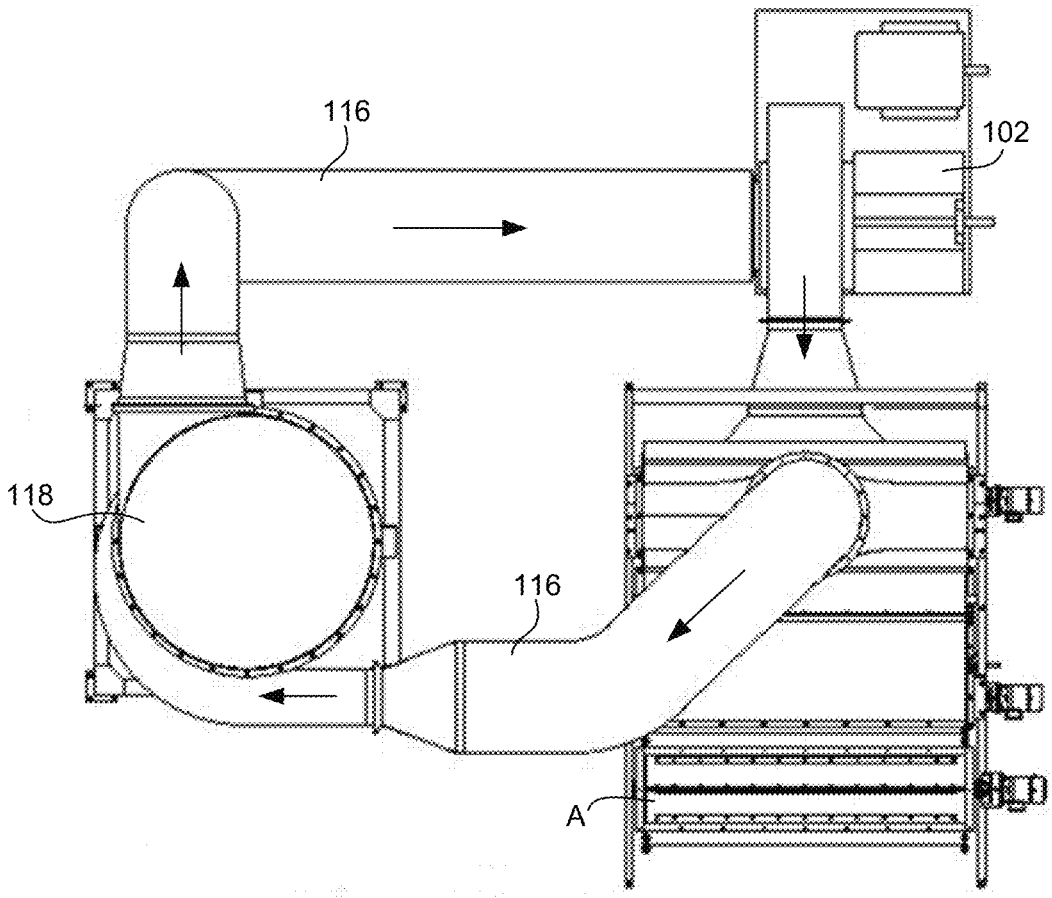
Figure 4:
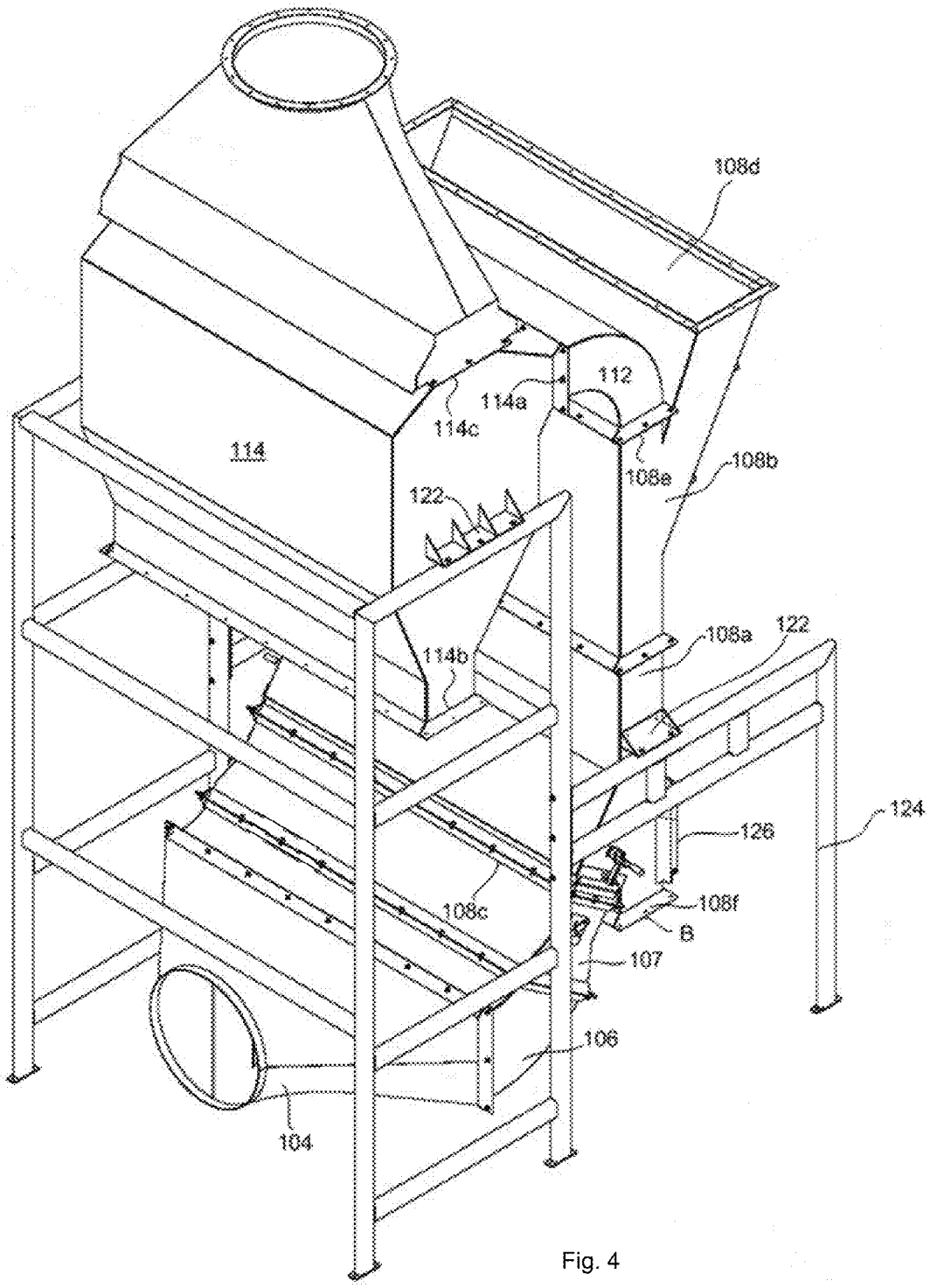
FIG. 4 is a perspective view of certain components of the classifier illustrated in FIGS. 1-3.

With reference to FIGS. 1-4, an exemplary air separation classifier system 100 will be described. FIGS. 1, 2, and 3 are perspective, side, and top views, respectively, of an air separation classifier system 100 according to an exemplary embodiment. FIG. 4 is a perspective view of certain components of the system 100 illustrated in FIGS. 1-3. The system 100 implements a closed air system to process solid materials.

An air flow producing device 102 produces air flow in the system 100 in the direction of the arrows illustrated in FIGS. 1-3 by drawing air from a return side of the air flow producing device 102 and pushing air through a supply side of the air flow producing device 102. The size of the air flow producing device can be adjusted to provide the desired air flow and pressures throughout the system 100. In an exemplary embodiment, the air flow producing device 102 is a 50-75 horsepower fan. The air flow producing device 102 can have a variable speed control to control the air flow created by the air flow producing device 102.

Figure 5:
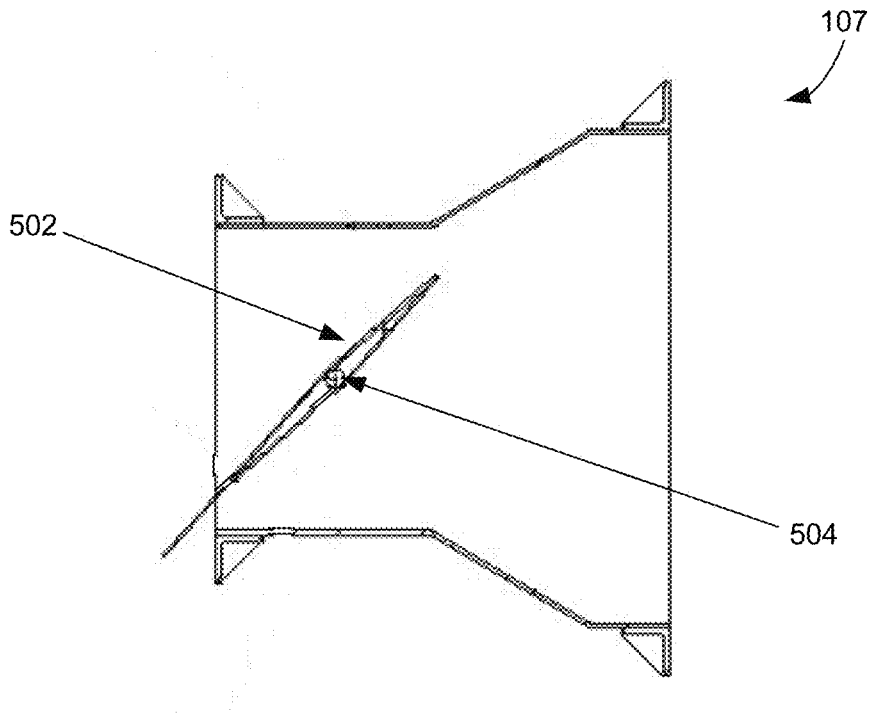
FIG. 5 is a cross sectional view of an air reducer according to an exemplary embodiment.

The air flow producing device 102 pushes air into the air intake 104. The air then flows from the air intake 104 through a lower transition 106, through an air reducer 107, and into a plenum 108. The air reducer 107 comprises a butterfly valve 502 (FIG. 5) that can be rotated around a shaft 504 (FIG. 5) to obstruct or unobstruct air flow through the air reducer 107, thereby controlling the air flow and velocity through the air reducer 107 and into the plenum 108.

The plenum 108 includes two sections, a lower plenum 108*a* and an upper plenum 108*b*. The air enters the lower plenum 108*a* via a lower entrance 108*c* in the lower plenum 108*a*.

Material to be separated is introduced into the system 100 at location A via an intake feeder (not shown). The material to be separated is fed into a first rotary valve 110 (A), which allows the material to fall into the upper plenum 108*b* via an upper entrance 108*d* in the upper plenum 108*b*. The first rotary valve 110 (A) also prevents all or a substantial amount of air from exiting the system 100 via the upper entrance 108*d* in the upper plenum 108*b*. The rotary valve 110 (A) prevents a sufficient amount of, in some cases all, air from exiting the system 100 to maintain the desired static pressures and air flows therein.

The air flows through the air intake 104, into the plenum 108, and up the plenum 108, where it interacts with the material to be separated as the material to be separated falls through the plenum 108 via the force of gravity.

The movement of air through the material to be separated causes lighter material to be entrained in the air flow while heavier material falls through the plenum 108. The heavier material falls through a lower exit 108*f* in the lower plenum 108*a* and exits the system 100 at location B via a second rotary valve 110 (B) attached to the lower exit 108*f* in the lower plenum 108*a*. The second rotary valve 110 (B) also prevents air from exiting the system 100 via the lower exit 108*f* in the lower plenum 108*a*, similarly to the operation of the first rotary valve 110 (A).

Some light material could remain with the heavy material, as the light material is physically entwined with the heavy material and the force of the air is insufficient to entrain the light material. The system 100 can minimize the amount of light material that is not entrained in the air by optimizing the residence time of the material to be separated in the plenum 108. By optimizing the residence time, the chances are increased that the air flow will separate the heavy and light fractions of material and that the light fractions will be entrained in the air. This optimization allows for the separation of materials that have relatively close densities.

Residence time of the material to be separated in the plenum 108 can be optimized in a number of ways. This optimization allows for highly efficient separation of the materials—the residence time is such that the material to be separated that falls through the plenum 108 under gravity is mixed with the moving air to maximize the amount of light materials that are entrained in the air as it moves up through the plenum 108. This process, in turn, maximizes the amount of heavy material, including, for example, copper wire, that falls out of the plenum 108. In other words, this increased residence time allows for a more complete separation of the light and heavy fractions of materials.

The material to be separated can be sized, such as in a granulator or other size reducing equipment, prior to entering the plenum 108. In exemplary embodiments, this step can be omitted, and the system 100 can process the material to be separated directly from a shredder or other process equipment without sizing.

Figure 6:
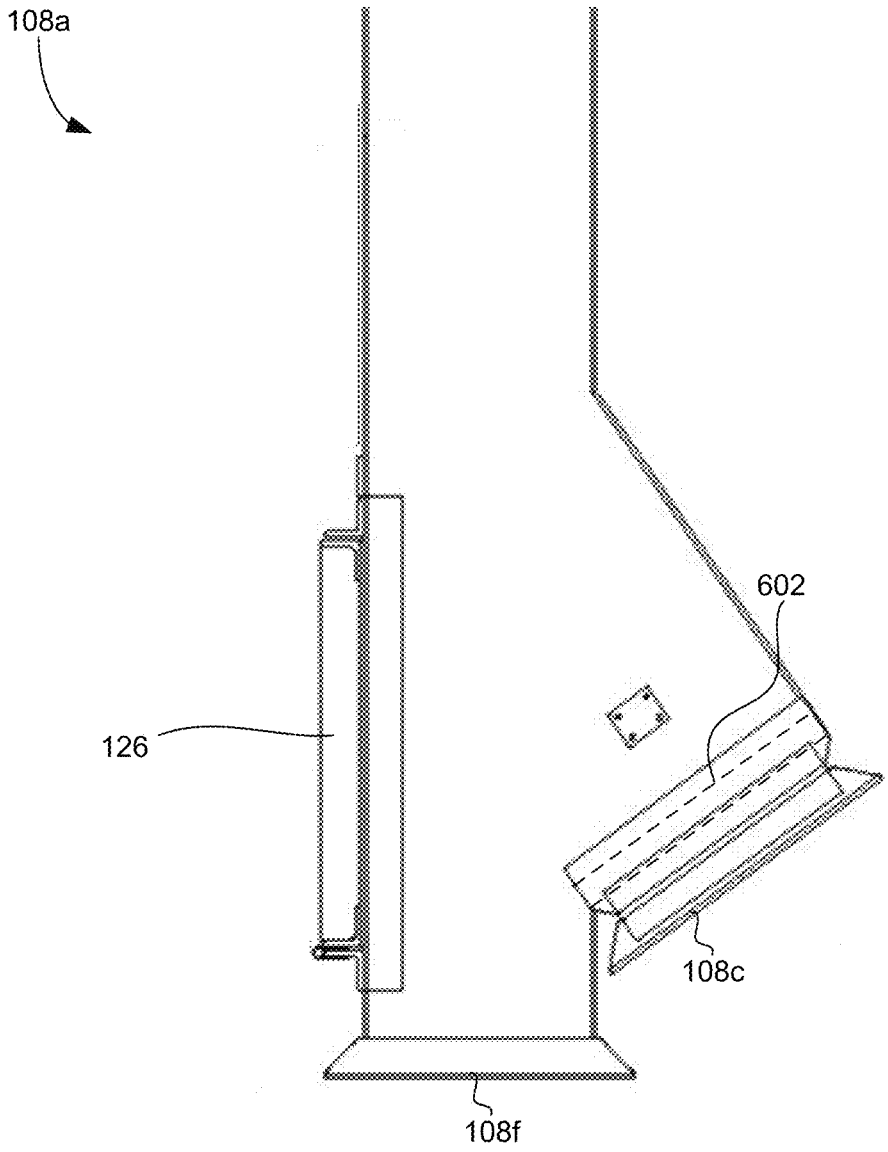
FIG. 6 is a side view of an expansion chamber according to an exemplary embodiment.

In one exemplary embodiment, the residence time in the plenum 108 is increased by matching the required air flow with the size of the material to be separated. An air diffuser plate 602 (FIG. 6) is added between the location where the air flow leaves the air flow producing device 102 and the location where the air flow enters the plenum 108. As illustrated in the exemplary embodiment of FIG. 7, the diffuser plate is disposed at the lower inlet in the plenum 108. The diffuser plate 602 creates minor back pressure and distributes the air flow evenly throughout the width of the plenum 108. The diffuser plate 602 can be a perforated metal plate and can have openings sized to maximize the residence time of the material to be separated based on the size of the material to be separated and the size of the air flow producing device 102. Examples for configurations for this plate range from a plate with one-half inch holes to a mesh screen, with many fine holes. For example, for material to be separated with a nominal size of 0-4 millimeters, the diffuser plate can have one-quarter inch holes. For larger size particles, a plate with larger holes may be used.

In the exemplary embodiment illustrated in FIGS. 1, 2, 4, and 7, the lower inlet in the plenum 108 is angled with respect to a vertical pathway through which the mixture and the heavy fraction of materials pass. In this manner, the heavy fraction of materials can fall through the plenum 108 to the lower exit 108*f* of the plenum 108 without falling onto and/or damaging the screen 602, which is positioned at the lower inlet in the plenum 108.

Alternatively or additionally, a depth of the plenum chamber can be optimized to achieve the maximum residence time for the waste material to be separated in the chamber. For example, the depth can be between 10 inches and 16 inches. The smaller depth can be used for smaller particle sizes. For example, the 10 inch depth can be matched to particles with a size range of 0-1 inch. In exemplary embodiments, a volume of the plenum 108, including a particular depth, width, height, and shape can be selected to obtain the desired static pressures and air flows in the plenum 108 and the system 100 and to process the desired type and size/density of materials.

In one exemplary embodiment, the following static pressures and air flow volumes for different particle size ranges are used:

| Particle Size | Static Pressure (in. of water) | Air Flow (cubic feet per minute) |
|---|---|---|
| 4 millimeters to ⅝ inches | 8 to 12 | 8,000 to 12,000 |
| ⅝ inches to 1.25 inches | 12 | 15,000 to 22,000 |
| 1.25 inches to 5 inches | 9 to 13 | 12,000 to 15,000 |

The sizes of the air flow producing device 102, the passageways and transitions through which the air flows, the plenum 108, the air reducer 107, the expansion chamber 114, and other components can be selected to obtain the desired static pressures and air flows throughout the system 100 and to process the desired type and size/density of materials.

As illustrated in FIGS. 1, 2, and 4, the lower plenum 108*a* can comprise an access door 126 to gain entry into an interior of the plenum 108.

The air with the entrained light fraction of materials moves up and out of the plenum 108, through an upper transition 112, and into an expansion chamber 114 via an entrance 114*a* in the expansion chamber 114. In the expansion chamber 114, the air and entrained light fraction of materials contact a redirecting plate 702 (FIG. 7), which redirects the path of the air and entrained light fraction of materials. As the velocity of the air slows in the expansion chamber 114, the entrained light fraction of materials falls to the bottom of the expansion chamber 114 and exits the system 100 at location C via a third rotary valve 110 (C) attached to a lower exit 114*b* in the expansion chamber 114. The third rotary valve 110 (C) also prevents air from exiting the system 100 via the lower exit 114*f* in the expansion chamber 114, similarly to the operation of rotary valves 110 (A, B).

The air then flows from an upper exit 114*c* of the expansion chamber 114, through ducting 116, and into a centrifugal filtering device 118.

The air flow producing device 102 pushes the air through the expansion chamber 114 and also draws the air from the centrifugal filtering device 118, which in turn draws air from the expansion chamber 114. The expansion chamber 114 can comprise a make-up air vent to allow air into the expansion chamber 114 to maintain the desired air flow and static pressure throughout the system 100. In exemplary embodiments, the make-up air vent can comprise a butterfly-type vent, a pressure actuated vent, or other suitable vent.

Figure 7:
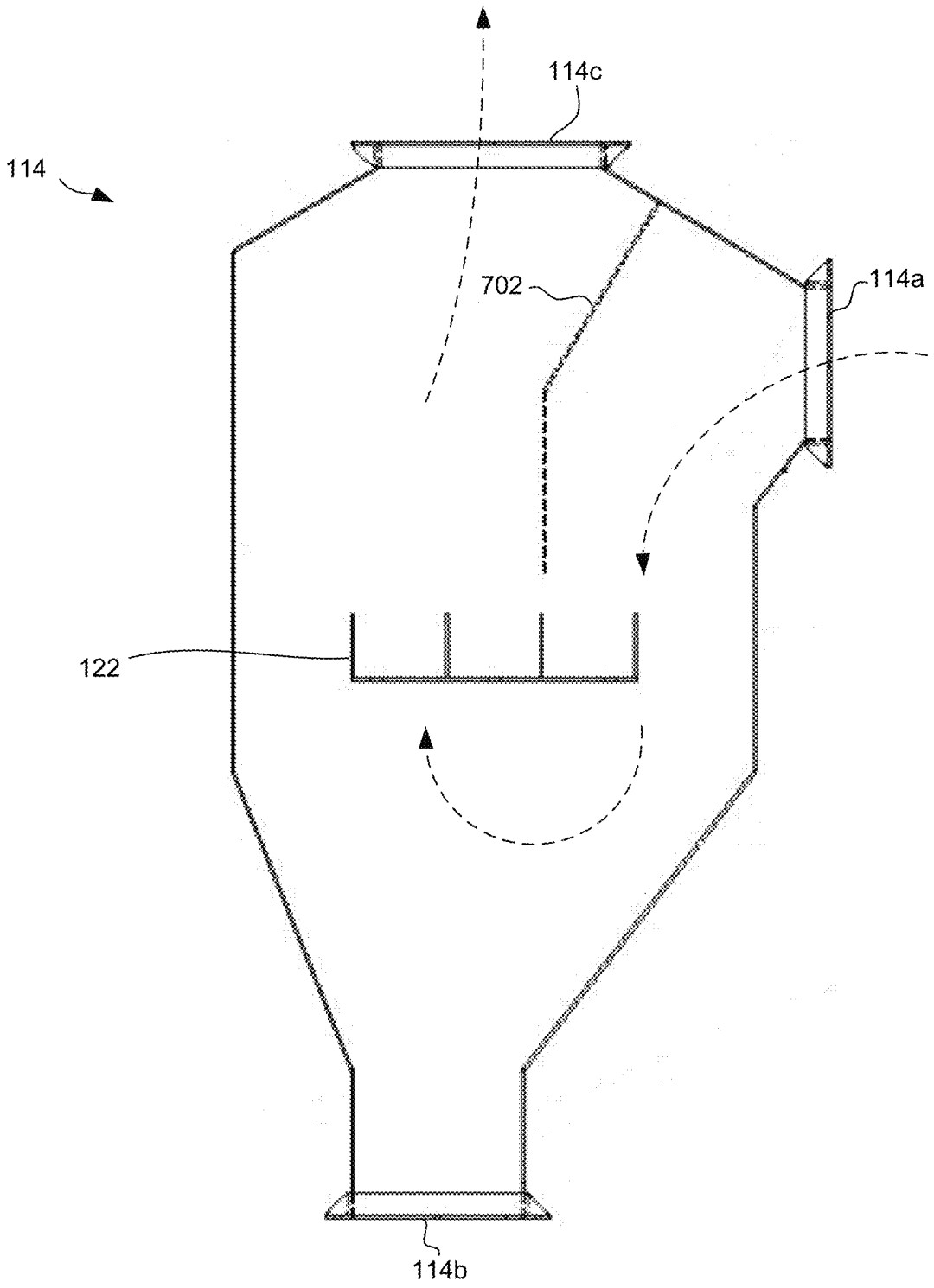
FIG. 7 is a side view of a lower air plenum according to an exemplary embodiment.

Referring to FIG. 7, the plate 702 prevents the air and entrained light fraction of materials from flowing directly through the expansion chamber 114, from the entrance 114*a* to the upper exit 114*c*. With the plate 702, the air flows through the expansion chamber in the general direction of the dashed arrows illustrated in FIG. 7, allowing time for the air flow to slow and for the light fraction of materials to fall to the bottom of the expansion chamber 114. The exemplary plate 702 includes two sections oriented and positioned to deflect the air flow in the desired direction. However, any suitable shape and position of the plate 702 can be used to redirect the air flow in the desired direction. Additionally, the shape and position of the plate 702 can be controlled to optimize the air flow based on the materials included in the light fraction of materials entrained in the air flow.

In exemplary embodiments, a volume of the expansion chamber 114, including a particular depth, width, height, and shape can be selected to obtain the desired static pressures and air flows in the expansion chamber 114 and the system 100 and to process the desired type and size/density of materials.

Referring back to FIGS. 1-3, the centrifugal filtering device 118 removes additional solid material that remains entrained in the air. In operation, the centrifugal filtering device 118 directs the flow of the air in a circular (cyclone) manner, which forces the remaining material to the outside of the centrifugal filtering device 118. The remaining material then falls to the bottom of the centrifugal filtering device 118 and exits the system 100 at location D via a fourth rotary valve 110 (D) attached to the centrifugal filtering device 118. The fourth rotary valve 110 (D) prevents air from entering the system 100 via the centrifugal filtering device 118 so air can only be drawn from the expansion chamber 114, similarly to the operation of rotary valves 110 (A, B, C) which prevent air from exiting the system 100.

Additionally or alternatively, other devices can be used to filter the air and/or recover materials from the air that is flowing through the system 100. For example, an inline filter can be used in the ducting 116. Any suitable device that further cleans the air returning to the fan while maintaining the desired air flow and static pressures in the system 100 can be used.

Alternatively, in a non-closed loop system embodiment, the filter can filter the air as it exits the expansion chamber 114 into the atmosphere.

In the exemplary embodiment illustrated in FIGS. 1-3, transitions 120 direct the air flow from the ducting 116 into the centrifugal filtering device 118 and from the centrifugal filtering device 118 into the ducting 116.

The air is then cycled back to the air intake 104. More specifically, the air flows from the centrifugal filtering device 118 through ducting 116 and returns to the air flow producing device 102. The air flow producing device 102 draws the air from the ducting 116 and pushes the air towards the plenum 108, thereby reusing the air throughout the system 100.

In this way, the process air loops through the system 100 and is not released to the atmosphere. The air path from the fan to the plenum 108 to the expansion chamber 114 to the centrifugal filter device 118 and back to the fan is closed. Valves (such as the rotary valves 110) and duct connections prevent the bleeding of air into the atmosphere.

The system 100 can comprise brackets 122 at various external locations to attach the system 100 to a support structure 124 that holds the components of the system 100 in place.

Materials separated via the system 100 can be usable materials or waste materials. In one exemplary embodiment, all of the materials can be waste materials that are separated and removed from the system 100 at locations A-D for proper disposal. In another exemplary embodiment, all of the materials can be recyclable materials that are separated and removed from the system 100 at locations A-D for recycling. In yet another exemplary embodiment, the materials can comprise both waste materials and recyclable materials that are separated and removed from the system 100 at locations A-D for proper disposal and recycling, respectively.

The rotary valves 110 described with reference to FIGS. 1-3 are exemplary "airlocks," which maintain a suitable air seal while allowing materials to enter or exit the system 100. However, other suitable types of airlocks can be used which maintain a suitable air seal while allowing materials to enter or exit the system 100.

Figure 8:
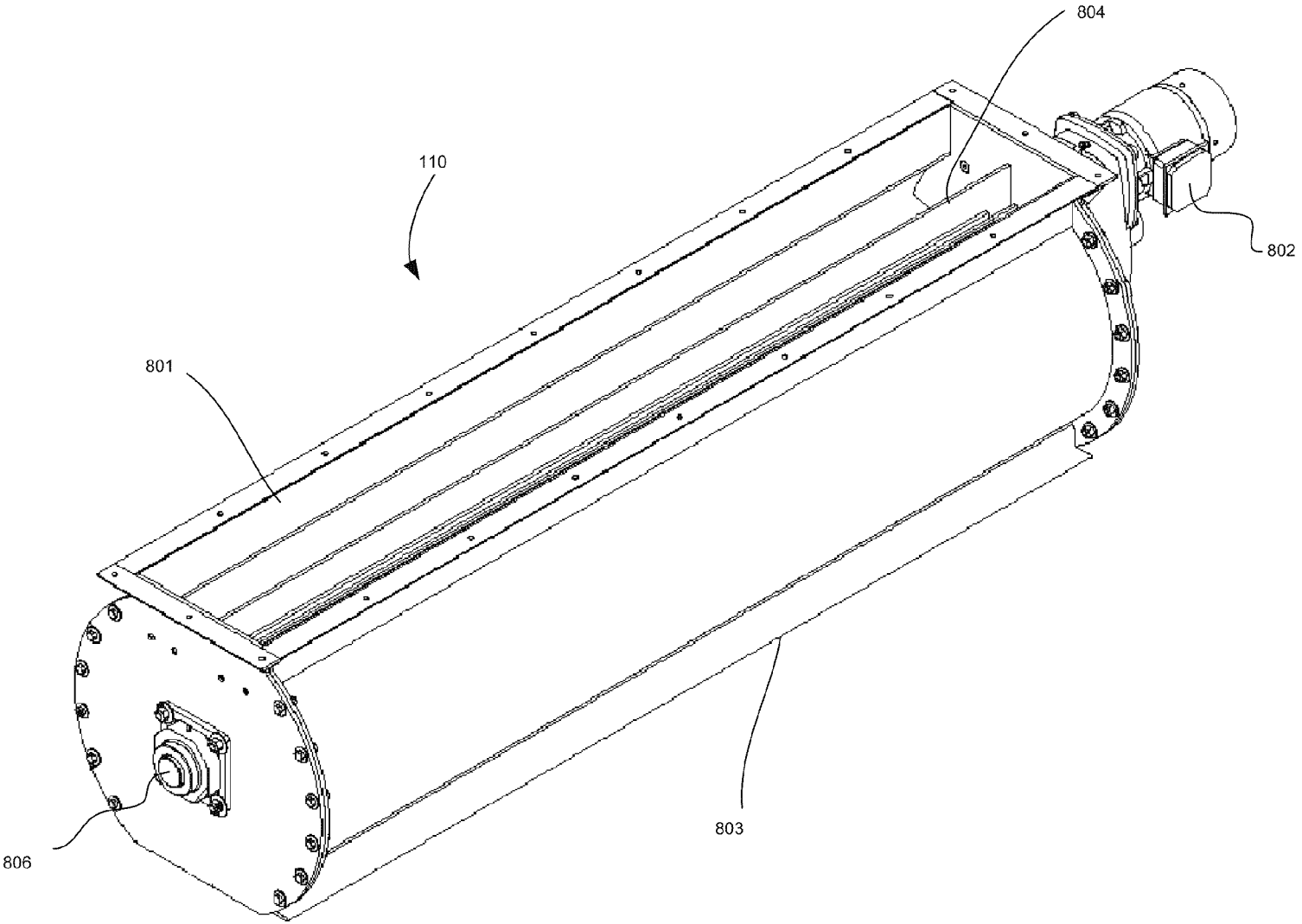
FIG. 8 is a perspective view of a rotary valve according to an exemplary embodiment.
Figure 9:
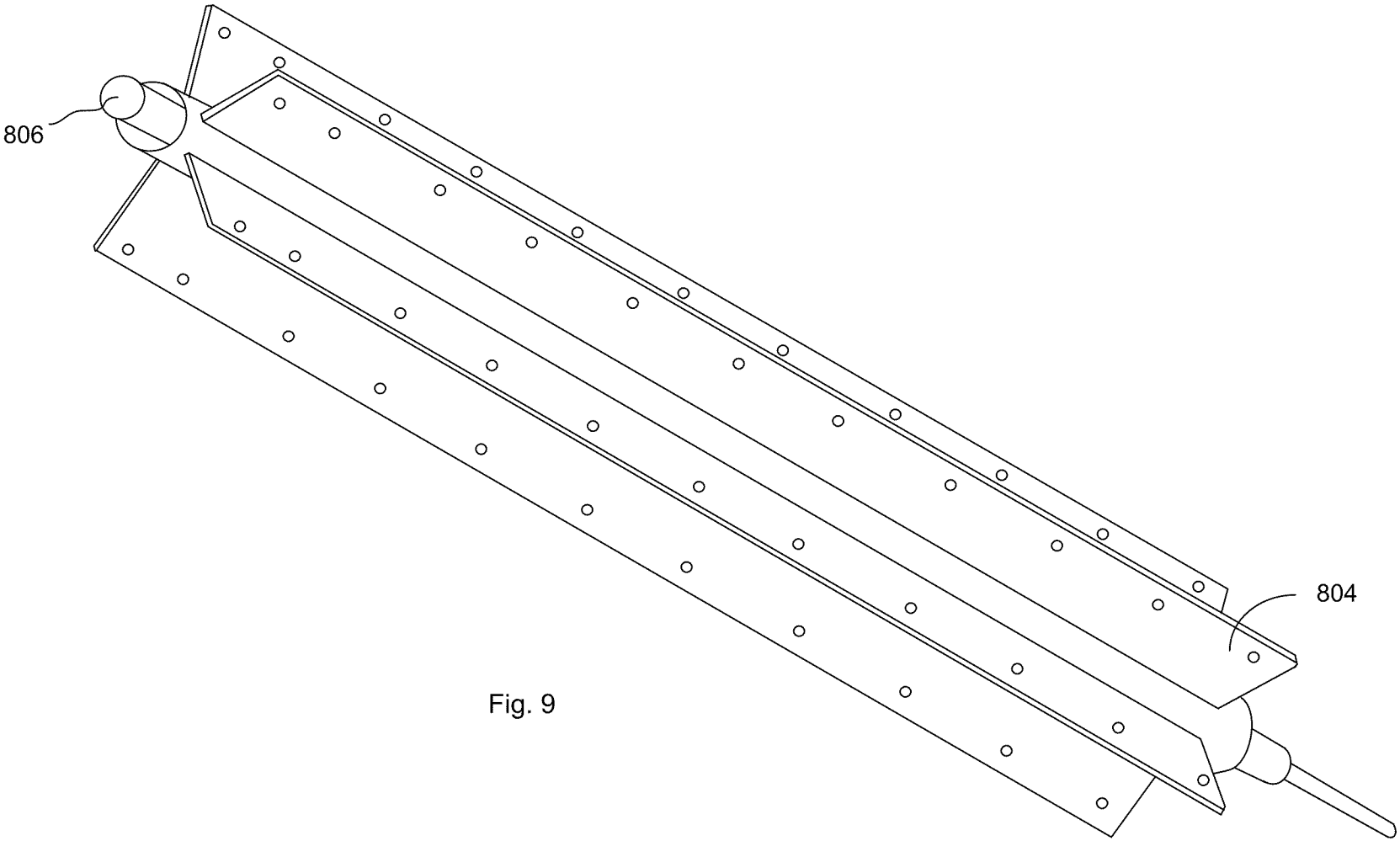
FIGS. 9 and 10 are perspective and end views, respectively, of an exemplary vane of the rotary valve depicted in FIG. 8.
Figure 10:
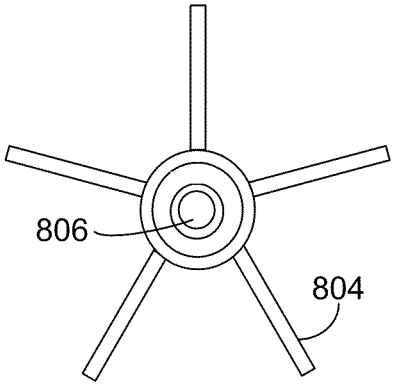

An exemplary rotary valve 110 will now be described with reference to FIGS. 8-10. FIG. 8 is a perspective view of a rotary valve 110 according to an exemplary embodiment. FIGS. 9 and 10 are perspective and end views, respectively, of an exemplary vane of the rotary valve 110 depicted in FIG. 8.

The rotary valve 110 comprises in inlet 801 through which material enters the rotary valve 110 and an exit 803 through which material exits the rotary valve 110. An interior of the rotary valve 110 houses multiple vanes 804 supported on a shaft 806. The vanes 804 are sizes to contact the interior of the rotary valve 110 during operation such that air does not pass through the rotary valve 110. In operation, a motor 802 turns the shaft 806, thereby turning the vanes 804. As the vanes 804 turn, material disposed between the vanes 804 is transferred from the inlet 801 to the exit 803.

The vanes 804 can comprise a material that creates a suitable seal with the interior of the rotary valve 110 to prevent air flow through the rotary valve 110.

FIG. 10 illustrates an exemplary embodiment comprising five vanes 804 disposed seventy-two degrees apart. Other configurations utilizing more or less vanes that prevent an air path through the rotary valve 110 are within the scope of the invention.

The description above uses the terms heavy fraction and light fraction to describe the two streams of material to be separated. One of ordinary skill in the art would understand that these terms are relative. In one exemplary embodiment, the light fraction can include fabric, rubber, and insulated wire, and the heavy fraction can include wet wood and heavier metals, such as non-ferrous metals including aluminum, zinc, and brass. In another exemplary embodiment, the light fraction can include fabric ("fluff"), and the heavy fraction can include insulated wire. Indeed, the apparatus of the present invention can be optimized to separate material within a narrow range of densities. As such, the processed material can range from raw shredder residue to a light fraction that was separated by a different separator technology, such as a Z-box air separator or sink/float separator.

One of ordinary skill in the art also would understand that the separator described above may be one step in a multi-step process that concentrates and recovers recyclable materials, such as copper wire from ASR and WSR.

Although specific embodiments of the present invention have been described in this application in detail, the description is merely for purposes of illustration. It should be appreciated, therefore, that many aspects of the invention were described above by way of example only and are not intended as required or essential elements of the invention unless explicitly stated otherwise. Certain steps and components in the exemplary processing methods and systems described herein may be omitted, performed and a different order, and/or combined with other steps or components. Various modifications of, and equivalent components corresponding to, the disclosed aspects of the exemplary embodiments, in addition to those described herein, can be made by those having ordinary skill in the art without departing from the scope and spirit of the present invention described herein and defined in the following claims, the scope of which is to be accorded the broadest interpretation so as to encompass such modifications and equivalent structures.

What is claimed is:

1. An apparatus for separating a mixture comprising at least two solid materials, comprising:

a separation chamber in which the solid materials are separated from each other, the separation chamber comprising an air intake and an air exit, wherein air flows through the separation chamber from the air intake to the air exit;

a passageway in which air flows from the air exit of the separation chamber to the air intake of the separation chamber;

a material intake and a material exit, wherein the mixture enters the separation chamber by way of the material intake, wherein a first one of the solid materials exits the separation chamber by way of the material exit, and wherein the air flowing through the separation chamber transports a second one of the solid materials through the air exit of the separation chamber and into the passageway; and an expansion chamber disposed in the passageway, the expansion chamber comprising an entrance coupled to the passageway, a material exit, a redirecting plate disposed within the expansion chamber, and an air exit coupled to the passageway, wherein the air transporting the second one of the solid materials through the air exit of the separation chamber and into the passageway enters the expansion chamber by way of the entrance in the expansion chamber, wherein at least a portion of the second one of the solid materials exits the expansion chamber via the material exit in the expansion chamber, and wherein the air exits the expansion chamber and into the passageway by way of the air exit in the expansion chamber.

2. The apparatus of claim 1, further comprising:

a first valve coupled to the material intake of the separation chamber, wherein the mixture passes through the first valve to enter the separation chamber, the first valve preventing substantially all air flowing through the separation chamber from exiting the separation chamber via the material intake; and a second valve coupled to the material exit of the separation chamber, wherein the first one of the solid materials passes through the second valve when exiting the separation chamber, the second valve preventing substantially all air flowing through the separation chamber from exiting the separation chamber via the material exit.

3. The apparatus of claim 2, wherein the first and second valves are rotary valves.

4. The apparatus of claim 1, further comprising a valve coupled to the material exit of the expansion chamber, wherein the second one of the solid materials passes through the valve when exiting the expansion chamber, the valve preventing substantially all of the air flowing through the expansion chamber from exiting the expansion chamber via the material exit.

5. The apparatus of claim 1, further comprising a centrifugal air cleaning device disposed in the passageway, the centrifugal air cleaning device comprising an entrance coupled to the passageway, a material exit, and an air exit coupled to the passageway, wherein the air exiting the expansion chamber and into the passageway enters the centrifugal air cleaning device via the entrance in the centrifugal air cleaning device, wherein at least a portion of particulate matter in the air entering the centrifugal air cleaning device exits the centrifugal air cleaning device via the material exit in the centrifugal air cleaning device, and wherein the air exits the centrifugal air cleaning device and enters the passageway via the air exit in the centrifugal air cleaning device.

6. The apparatus of claim 5, further comprising a valve coupled to the material exit of the centrifugal air cleaning device, wherein the at least a portion of particulate matter passes through the valve when exiting the centrifugal air cleaning device, and wherein the valve prevents substantially all of the air flowing through the centrifugal air cleaning device from entering the centrifugal air cleaning device via the material exit.

7. The apparatus of claim 5, further comprising a fan disposed in the passageway, wherein the fan draws the air from the centrifugal air cleaning device through the passageway and forces the air into the passageway and into a plenum.

8. The apparatus of claim 1, wherein the air intake is disposed at an angle with respect to a vertical axis of the separation chamber.

9. The apparatus of claim 8, further comprising a diffuser plate disposed across the air intake.

10. The apparatus of claim 1, wherein the material exit is disposed directly below a pathway in which the first one of the solid materials passes through the separation chamber.

11. A system for separating a mixture comprising at least two solid materials, comprising:

a separation chamber in which at least a portion of the solid materials are separated from each other;

a first valve coupled to the separation chamber, wherein the mixture passes through the first valve and enters the separation chamber;

a fan that forces air into the separation chamber, wherein air flowing through the separation chamber interacts with the mixture therein and forces a first one of the solid materials out of the separation chamber while allowing a second one of the solid materials to remain in the separation chamber;

a second valve through which the second one of the solid materials is removed from the separation chamber;

an enclosed passageway via which the air that forces the first one of the solid materials out of the separation chamber is returned to the fan, wherein the first and second valves prevent air from exiting the system therethrough; and a secondary chamber in which the air that forces the first one of the solid materials out of the separation chamber is directed via the passageway, wherein at least a portion of the first one of the solid materials is separated from the air in the secondary chamber, wherein the fan draws the air from the secondary chamber into the passageway to be returned to the fan, and wherein the secondary chamber comprises a directing member disposed within the secondary chamber that directs the air away from a location where the air exits the secondary chamber.

12. The system of claim 11, wherein the first and second valves prevent all air entering the plenum from exiting the plenum therethrough.

13. The system of claim 11, wherein the first and second valves are rotary valves.

14. The system of claim 11, further comprising a third valve through which the first one of the solid materials is removed from the secondary chamber, wherein the third valve prevents air from exiting the system therethrough.

15. The system of claim 11, further comprising a filter that removes particulate matter from the air in the passageway as the air is returned to the fan.

16. The system of claim 15, wherein the filter is a centrifugal air cleaning device disposed in the passageway.

17. The system of claim 15, wherein the filter comprises a fourth valve through which particulate matter removed from the air by the filter is removed from the system, and wherein the fourth valve prevents air from entering the system therethrough.

18. The system of claim 11, wherein the separation chamber comprises an air intake, the air intake being disposed out of a pathway in which the second one of the solid materials passes through the separation chamber.

19. The system of claim 18, further comprising a diffuser plate disposed across the air intake.

20. The system of claim 11, wherein the separation chamber comprises an air intake, the air intake being disposed at an angle with respect to a vertical axis of the separation chamber.

21. A system for separating a mixture comprising at least two solid materials, comprising:

a separation chamber in which at least a portion of the solid materials are separated from each other;

a first valve coupled to the separation chamber, wherein the mixture passes through the first valve and enters the separation chamber;

a fan that forces air into the separation chamber, wherein air flowing through the separation chamber interacts with the mixture therein and forces a first one of the solid materials out of the separation chamber while allowing a second one of the solid materials to pass through the separation chamber;

a second valve through which the second one of the solid materials is removed from the system;

a secondary chamber in which the air that forces the first one of the solid materials out of the separation chamber is directed, wherein at least a portion of the first one of the solid materials is separated from the air in the secondary chamber, and wherein the fan draws the air from the secondary chamber back to the fan wherein the secondary chamber comprises a directing member disposed therein that directs the air away from a location where the air exits the secondary chamber to be returned to the fan; and a filter that removes matter from the air as the air is returned to the fan, wherein the first and second valves prevent air from exiting the system therethrough.

22. The system of claim 21, further comprising a third valve through which the first one of the solid materials is removed from the system, wherein the third valve prevents air from exiting the system therethrough.

23. The system of claim 21, wherein the filter is a centrifugal air cleaning device.

24. The system of claim 23, wherein the filter comprises a fourth valve through which matter removed from the air by the filter is removed from the system, and wherein the fourth valve prevents air from entering the system therethrough.

25. The system of claim 21, wherein the separation chamber comprises an air intake via which air from the fan enters the separation chamber, the air intake being disposed out of a pathway in which the second one of the solid materials passes through the separation chamber.

26. The system of claim 25, further comprising a diffuser plate disposed across the air intake.

* * * * *